United States Patent [19]

van Straaten

[11] Patent Number: 5,029,850

[45] Date of Patent: Jul. 9, 1991

[54] EXERCISING APPARATUS

[75] Inventor: Willem J. van Straaten, Sandton, South Africa

[73] Assignee: Verimark (Proprietary) Limited, Transvaal, South Africa

[21] Appl. No.: 439,702

[22] Filed: Nov. 21, 1989

[30] Foreign Application Priority Data

Aug. 21, 1989 [ZA] South Africa ..... 89/6366

[51] Int. Cl.[5] ..... A63B 21/02; A63B 21/04

[52] U.S. Cl. ..... 272/137; 272/135; 272/143

[58] Field of Search ..... 272/72, 120, 126, 131, 272/133, 134, 135, 136, 137, 138, 139, 143, 144

[56] References Cited

U.S. PATENT DOCUMENTS

D. 284,597 7/1986 Smith et al. ..... 272/120
1,019,861 3/1912 Titus ..... 272/138
1,738,987 12/1929 Dattilo .
1,979,783 11/1934 Williams et al. .
4,004,801 1/1977 Campanaro et al. ..... 272/120
4,725,057 2/1988 Shifferaw ..... 272/136

FOREIGN PATENT DOCUMENTS 429527 5/1935 United Kingdom ..... 272/72

*Primary Examiner*—Richard J. Apley
*Assistant Examiner*—Lynne A. Reichard
*Attorney, Agent, or Firm*—Burns, Doane, Swecker & Mathis

[57] ABSTRACT

Elastic bands extend between anchor points on a bottom bar and pulleys on a top bar. Their free ends are engaged individually or jointly by handles. A brace extends between stretchers spacing the bars apart. By standing on the bottom bar while the apparatus leans against a wall a large number of exercises can be performed by manipulating the handles. The device can be inverted for further exercises or laid flat for further exercises.

12 Claims, 3 Drawing Sheets

Fig 1
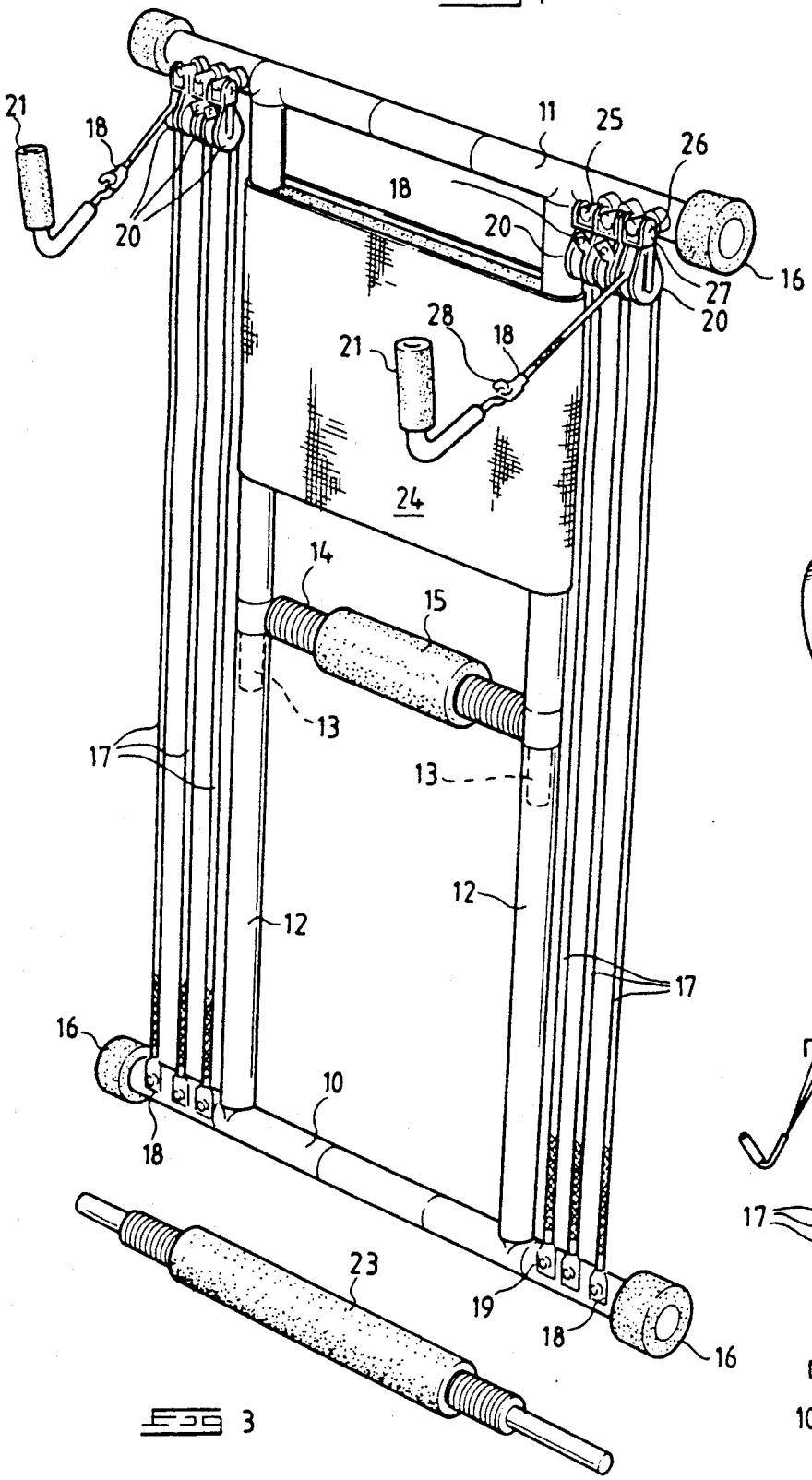
Fig 3
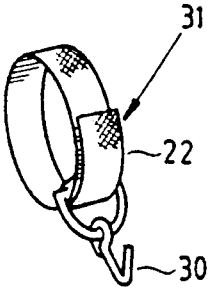
Fig 2
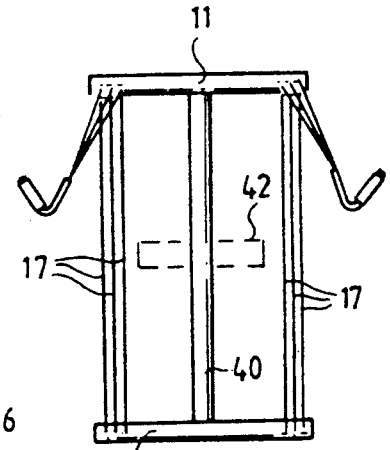
Fig 9

EXERCISING APPARATUS

BACKGROUND TO THE INVENTION

This invention relates to exercising apparatus of the kind in which an exerciser operates against the action of elastic bands.

In previous proposed apparatuses of the kind in question the band or bands acted on a slide or trolley mounted on a rail system—see U.S. Pat. Nos. 1 738 987 and 1 979 783. In any case the variety of exercises possible with the previous proposals was rather limited. In another case the present applicant has proposed an inclined rail machine in which the bands assisted gravity acting on a slide.

Due to the mechanisms that have to be provided to ensure proper sliding such machines tend to be relatively expensive.

SUMMARY OF THE INVENTION

The invention provides an exercising apparatus comprising a frame with opposed first and second sides, at least one pair of spaced apart direction changing elements on the first side, a pair of elastic band ends extending from the second side and passing over the direction changing elements, and handles attachable to the band ends, the frame being arranged for a user of apparatus to apply a reaction force to the frame with a part of his body to hold the frame in position while he manipulates the handles against the elastic band resistance.

The band ends may be the ends of bands anchored at the second side or they may be the ends of a single band passing around a formation or formations on the second side.

The direction changing elements are preferably pulleys.

In one form of the invention there are first points on the second side for the attachment of first ends of a plurality of elastic bands, direction-changing pulleys mounted on the first side at second points spaced away from the first points, the opposite free ends of the bands passing around the pulleys.

The frame may comprise first and second spaced apart, parallel bars, the first points being on the first bar and the second points being on the second bar, a pair of spaced apart, parallel frame members connecting the first bar to the second bar, and a bracing bar which is parallel to the first and second bars and which spans between the frame members, the bracing bar being positioned for a user to apply a reaction force thereto to hold the frame in position while he manipulates the handles to stretch the bands. Preferably, the bracing bar is situated roughly midway between the first and second bars, and the dimensions of the frame are such that with the first or the second bar resting on the floor, the other bar against a wall or other upright supporting surface and the frame members at an inclination to the vertical, the bracing bar is at a convenient height for a user to rest his buttocks upon the bracing bar. Preferably also, the apparatus comprises a cushioned backrest spanning between the frame members at a position between the bracing bar and the second bar.

In another version of the invention, the apparatus comprises a single frame member spanning transversely between the first and second bars and connected centrally to those bars. The single frame member may carry a cross-bar, parallel to the first and second bars and situated roughly midway therebetween.

In either case, the apparatus may comprise a plurality of elastic bands extending between the first and second bars, the handles being individually and collectively attachable to the free ends of the bands.

In the context of the above statements and the appended claims, the term "handles" also includes straps which are engageable with the legs, ankles or feet of a user.

DESCRIPTION OF THE DRAWINGS

The invention will now be described in more detail, by way of example only, with reference to the accompanying drawings in which :

FIG. 1 is a perspective view of apparatus according to the invention,

FIG. 2 is a view of a leg strap,

FIG. 3 is a view of a yoke bar,

FIG. 9 shows a view of a second embodiment.

DESCRIPTION OF EMBODIMENTS

Figure 4:
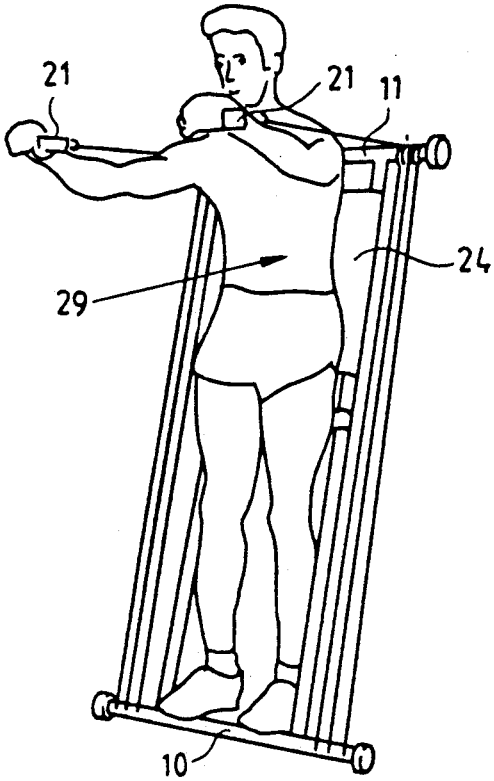
FIGS. 4 to 8 illustrate the versatility of the apparatus.

The apparatus of FIG. 1 comprises a frame composed of opposed side members in the form of bars 10 and 11 held apart by stretcher or spacing members 12. Each stretcher member 12 has two parts which engage at spigot and socket joints 13. A bracing bar 14 covered by a sponge rubber sleeve 15 spans between the stretcher members about midway between the bars 10 and 11. The ends of the bars 10 and 11 carry protective rubber sleeves 16.

Elastic bands 17 provide the resistance elements of the apparatus. Each band 17 has a metallic ferrule 18 crimped on to each of its ends with an eye formed in the ferrule. On the bar 10 the eyes of the ferrules 18 engage studs 19 fixed to that bar. On the bar 11 a series of deflecting pulleys 20 are pivotally connected to stubs 25 as shown. The pulleys 20 are capable of pivotal movement relative to the bar 11 about the axes of pins 26 which connect clevis members 27 to the stubs 25. The clevis members 27 are connected pivotally to the frames of the pulleys themselves, with the result that the pulleys 20 are capable of pivotal movement relative to the bar 11 about two axes at right angles to one another. The free ends of the bands 17 pass around the pulleys and hooks 28 provided on handles 21 can be engaged with the eyes of the ferrules 18. The hooks 28 can engage any one of, a pair of or all three of the ferrules 18 of the bands 17. The bands 17 are of different strengths. A cushioned backrest 24 spans between the stretchers 12.

The described apparatus can be used to perform a very wide range of exercises, each designed to affect different muscles of the body. Five typical examples of the wide range of exercises are illustrated in FIGS. 4 to 8 of the drawings.

In FIG. 4, the bar 10 is placed on the floor a short distance, say 600 mm, from a wall against which the bar 11 rests. The user 29 stands on the bar 10 and leans back against the backrest 24 with the underside of his buttocks resting on the bracing bar 14. He grasps the handles 21, which are hooked to the chosen one or ones of the bands 17 and performs a bench press exercise by pushing forwardly with his arms against the resistance of the bands. Having extended his arms fully on the "power" stroke, he allows them to be pulled back by the hands as they contract, and then repeats the exercise as many times as required.

With the apparatus in the orientation just described, a variety of other exercises can also be performed. The pivotal mountings of the pulleys 20 enables them to swivel to permit the user to perform, for instance, chest pull exercises by extending his arms sideways instead of forwardly. Similarly, the user may perform shoulder press exercises by pushing his arms upwardly as opposed to forwardly or to the sides.

Figure 5:
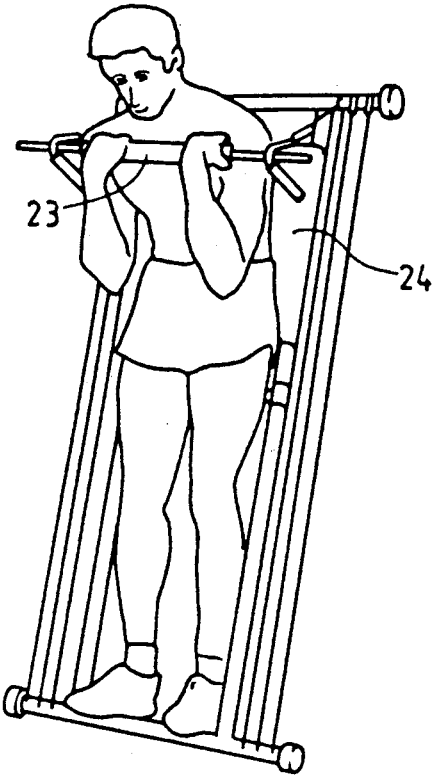

In FIG. 5, the apparatus is in the same orientation as in FIG. 4, but in this case a separate yoke bar 23, illustrated in FIG. 3, has its free ends engaged behind the handles 21. The user again stands on the bar 10 and leans back against the backrest with his buttocks resting on the bracing bar 14. He grasps the bar as illustrated and exercises his abdominal muscles by bending forwardly repeatedly from the waist. Naturally, the bands 17 provide resistance to this movement and, depending on the number and identity of the bands 17 which are hooked to the handles, an efficient working of the abdominal muscles is achieved. This exercise also has many variations. For instance, the user may, in addition to bending forwardly from the waist, also swivel his upper torso to the side, thereby working the side abdominal muscles.

Figure 6:
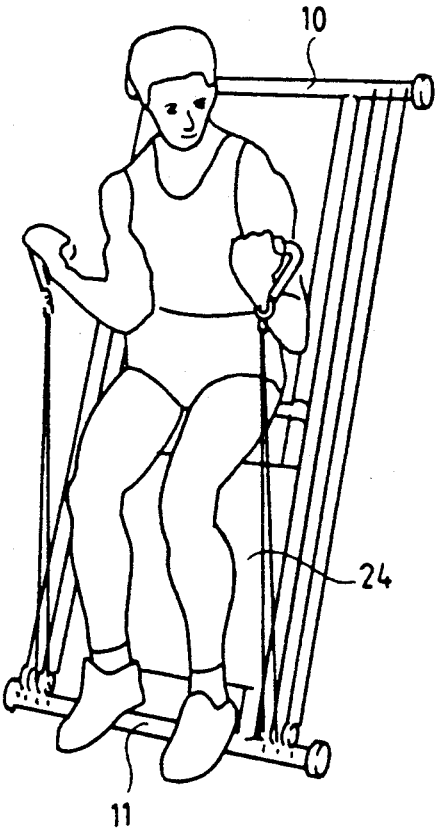

In FIG. 6, the apparatus has been inverted, such that the bar 11 rests upon the floor and the bar 10 rests against the wall. The backrest in this orientation of the apparatus is at the bottom as illustrated. The user sits on the bracing bar 14 and grasps the handles 21. He is now able to perform a so-called "curl" exercise by bending his arms upwardly at the elbows, against the resistance of the bands 17, thereby exercising his bicep muscles. Instead of bending his arms at the elbows, the user can merely flex his wrists, thereby exercising the wrist muscles.

Figure 7:
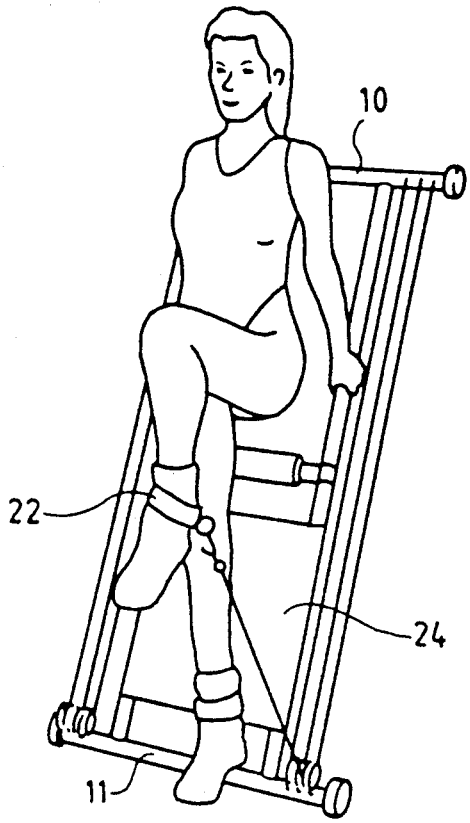

In FIG. 7, the apparatus is at the same orientation as in FIG. 6, but in this case the handles 21 are replaced by ankle straps 22 seen in FIG. 2. These straps have hooks 30 corresponding to the hooks 28 of the handles 21 and a flexible strap which can be secured in a loop by means of a Velcro-type fastener 31. The user stands on the bar 11 with one foot and fastens one of the straps 22 about her other ankle while reaching rearwardly with her arms to grip the stretcher members 12 as illustrated. By repeatedly lifting her leg against the resistance of the bands 17, the thigh and abdominal muscles can be efficiently exercised. Once again there are many variations. For instance, instead of lifting the leg forwardly as illustrated, the leg can lifted to the side, thereby exercising a different set of upper leg muscles.

Figure 8:
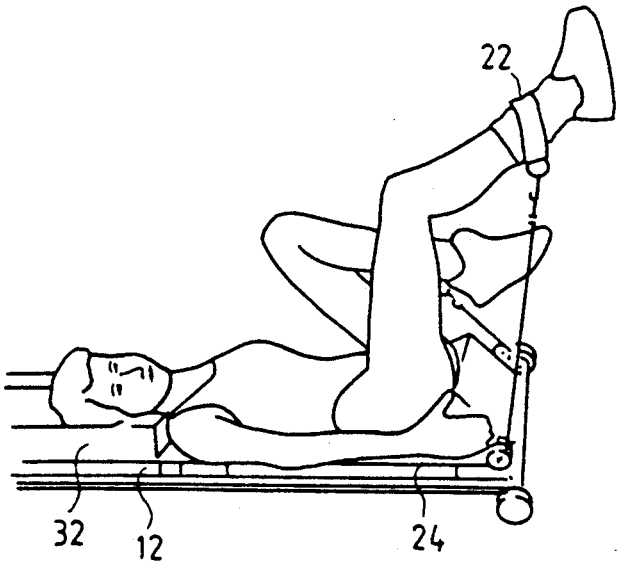

In FIG. 8, the apparatus is laid out on the floor and the user fastens the straps 22 about her ankles while lying with her back on the backrest 24 and her head supported by a pillow 32. The user now performs a cycling motion with the legs, thereby exercising the thigh, buttock and abdominal muscles. With the apparatus at the same orientation, the user can exercise the calf muscles by fastening the straps 22 to the feet and then flexing the feet at the ankles against the resistance of the bands 17.

FIG. 4 to 8 illustrate only a few of the many different exercises which are possible with the apparatus. Once a user becomes accustomed to the operation of the apparatus he or she will in all likelihood be able to devise many other exercises designed to exercise specific muscles of the body.

The apparatus in its assembled condition as illustrated can easily be stored upright behind a door. It is readily transportable in this condition. With the joints 13 disengaged, the apparatus occupies even less space and can be stored compactly in a bag or the like. The bars 10, 11 and 14 and the stretcher members 12 will preferably be made of aluminum tubing for lightness.

In each case, it will be appreciated that the apparatus depends for its operation on the fact that some or other part of the user's body acts against the frame of the apparatus while force is exerted in an opposite direction against the resistance of the bands 18. For instance, in FIGS. 4, 5 and 6, the user acts with his or her buttocks against the bracing bar 14. In FIG. 7, the user acts against the stretcher members 12 with her arms. In FIG. 8, the user acts against the backrest with her body weight. In each of these cases, the user acts rearwardly against the frame, but is equally possible for the user to act forwardly against the frame and to extend the bands 17 to the rear. For instance, the user could, in the FIG. 4 orientation of the apparatus, act forwardly against the backrest 24 with his chest and extend the bands 17 to the rear with his arms.

It will also be appreciated that it is not strictly necessary for the frame to lean against a wall or floor for stability. It is in fact the action of the user's body which maintains the position of the frame against the forces applied in stretching the bands 17.

Many variations of the illustrated embodiment are within the scope of the invention. For instance, the spaced apart stretcher members 12 could be replaced by a single spine bar 40, as shown in FIG. 9, which is connected centrally to the bars 10 and 11 and which spans between them. In this case, the user could merely act with a part of his body against the spine bar in the relevant exercises, or the single spine bar could carry a short cross-bar 42 against which the user's buttocks could act. This kind of embodiment, although somewhat simpler than the embodiment of FIGS. 1 to 8, would have the disadvantage that the spine bar would be rather uncomfortable to lie on in exercises such as that depicted in FIG. 8, but suitable padding for the spine bar could be provided to overcome this problem.

In a further modification having a frame similar to that seen in FIG. 1, the band attachment point and pulleys could be mounted at opposite ends of the stretcher members rather than on the bars 10 and 11.

I claim:

1. An exercising apparatus comprising a substantially planar frame having opposed first and second side members, spacing means spacing the side members apart, at least one pair of spaced apart direction changing elements mounted on the first side member, a plurality of elastic bands extending from the second side member and passing over the direction changing elements and terminating in respective band free ends, handles attached to the band free ends, and a bracer mounted on the spacing means and so arranged that with the side members resting against rigid surfaces and the midbody of a user of the apparatus applying a staying force to the bracer, the frame is held fixed in position while the user manipulates the handles against the elastic band resistance.

2. An exercising apparatus according to claim 1 in which the bands include respective anchoring ends anchored at the second side member.

3. An exercising apparatus according to claim 2 in which the direction changing elements are pulleys.

4. An exercising apparatus according to claim 3 wherein the first and second side members comprise first and second spaced apart, parallel bars, the pulleys being mounted on the first bar and the anchoring ends being anchored to the second bar, the spacing means comprising a pair of spaced apart, parallel frame members connecting the first bar to the second bar, the bracer comprising a bracing bar which is parallel to the first and second bars and which spans between the frame members, the bracing bar being positioned for a user to apply a reaction force thereto to hold the frame in position while manipulating the handles to stretch the bands.

5. An exercising apparatus according to claim 4 wherein the bracing bar is situated roughly midway between the first and second bars, and the dimensions of the frame are such that with the first or the second bar resting on the floor, the other bar against a wall or other upright supporting surface and the frame members at an inclination to the vertical, the bracing bar is at a convenient height for a user to rest his buttocks upon the bracing bar to apply a reaction force thereto during manipulation of the handles.

6. An exercising apparatus according to claim 3 wherein the first and second sides are formed by first and second spaced apart, parallel bars, the pulleys being mounted on the first bar and the anchoring ends being anchored to the second bar, the spacing means comprising a single frame member spanning transversely between the first and second bars and connecting them to one another.

7. An exercising apparatus according to claim 2 wherein the first and second side members are removably connectable to the spacing means by spigot-and-socket connectors.

8. An exercising apparatus according to claim 1 comprising a separate rigid bar which is engageable to both of the handles so as to extend between the handles at an orientation parallel to the first and second side members.

9. An exercising apparatus according to claim 1 wherein the mounting of the bracer on the spacing means secures the bracer against free sliding movement along the spacing means as a user manipulates the handles.

10. An exercising apparatus according to claim 9 wherein the bracer extends generally parallel to the first and second side members at a location situated roughly midway between the first and second side members so that the bracer is at a position suitable to form a support for a user's buttocks regardless of whether the user's feet are located near the first side member or second side member.

11. An exercising apparatus according to claim 10 wherein there are first and second groups of direction changing elements mounted on the first side member, each group of direction changing elements comprising at least two direction changing elements, the groups of direction changing elements being located adjacent respective opposite ends of the first side member, there being a separate elastic band for each direction changing element, whereby the elastic bands form first and second groups of bands, the elastic bands of the first group of elastic bands being individually removably connectable to a first of the handles, and the elastic bands of the second group of elastic bands being individually removably connectable to a second of the handles, so that the amount of elastic resistance can be varied.

12. An exercising apparatus according to claim 1 wherein there are first and second groups of direction changing elements mounted on the first side member, each group of direction changing elements comprising at least two direction changing elements, the groups of direction changing elements being located adjacent respective opposite ends of the first side member, there being a separate elastic band for each direction changing element, whereby the elastic bands form first and second groups of bands, the elastic bands of the first group of elastic bands being individually removably connectable to a first of the handles, and the elastic bands of the second group of elastic bands being individually removably connectable to a second of the handles, so that the amount of elastic resistance can be varied.

* * * * *